US008007356B2

(12) United States Patent
York et al.

(10) Patent No.: US 8,007,356 B2
(45) Date of Patent: Aug. 30, 2011

(54) METHOD FOR CONDUCTING A LOTTERY

(75) Inventors: Travis York, Manchester, NH (US); Patrick Griffin, Bedford, NH (US)

(73) Assignee: Griffin York & Krause, Manchester, NH (US)

( * ) Notice: Subject to any disclaimer, the term of this patent is extended or adjusted under 35 U.S.C. 154(b) by 530 days.

(21) Appl. No.: 11/999,849

(22) Filed: Dec. 7, 2007

(65) Prior Publication Data

US 2008/0174068 A1 Jul. 24, 2008

Related U.S. Application Data

(60) Provisional application No. 60/873,319, filed on Dec. 7, 2006.

(51) Int. Cl.
*A63F 9/24* (2006.01)

(52) U.S. Cl. ..... 463/17; 273/139

(58) Field of Classification Search ..... 273/139, 273/274, 269; 463/17, 43
See application file for complete search history.

(56) References Cited

U.S. PATENT DOCUMENTS

| | | | | |
|---|---|---|---|---|
| 5,772,510 | A | 6/1998 | Roberts | |
| 6,086,477 | A * | 7/2000 | Walker et al. | 463/17 |
| 6,599,186 | B1 * | 7/2003 | Walker et al. | 463/17 |
| 6,773,345 | B2 | 8/2004 | Walker et al. | |
| 6,908,382 | B2 * | 6/2005 | Walker et al. | 463/17 |
| 7,166,029 | B2 | 1/2007 | Enzminger | |
| 7,175,525 | B2 | 2/2007 | Lind | |
| 7,300,349 | B2 * | 11/2007 | Walker et al. | 463/17 |
| 7,384,332 | B2 * | 6/2008 | Walker et al. | 463/17 |
| 7,384,333 | B2 * | 6/2008 | Walker et al. | 463/17 |
| 7,534,169 | B2 * | 5/2009 | Amaitis et al. | 463/39 |
| 7,708,630 | B2 * | 5/2010 | Nicely | 463/17 |
| 2005/0140091 | A1 | 6/2005 | Brickwood et al. | |
| 2006/0142076 | A1 | 6/2006 | Willyard et al. | |
| 2006/0142080 | A1 | 6/2006 | Enzminger | |
| 2006/0148552 | A1 | 7/2006 | Malle et al. | |
| 2006/0154718 | A1 | 7/2006 | Willyard et al. | |
| 2006/0178186 | A1 | 8/2006 | Lind | |
| 2006/0205478 | A1 | 9/2006 | Padgett | |
| 2006/0211483 | A1 | 9/2006 | Padgett | |
| 2006/0223626 | A1 | 10/2006 | Walker et al. | |
| 2006/0229123 | A1 | 10/2006 | Owen | |
| 2006/0247019 | A1 | 11/2006 | Watkins | |
| 2006/0252480 | A1 | 11/2006 | Owen | |
| 2007/0010319 | A1 | 1/2007 | Lind et al. | |
| 2007/0021163 | A1 | 1/2007 | Lind et al. | |
| 2007/0021164 | A1 | 1/2007 | Lind et al. | |
| 2007/0038466 | A1 | 2/2007 | Lind et al. | |
| 2007/0060288 | A1 | 3/2007 | Willyard et al. | |
| 2007/0060293 | A1 | 3/2007 | Svanas | |
| 2007/0060341 | A1 | 3/2007 | Lind | |

(Continued)

*Primary Examiner* — William Pierce
(74) *Attorney, Agent, or Firm* — Peter A. Nieves; Sheehan Phinney Bass + Green, PA

(57) ABSTRACT

A method of conducting a lottery includes registering a player with one or more losing tickets for one or more opportunities to enter one or more additional lotteries while collecting identifying information about the registered player. Allocating points to the registered player for each of the one or more losing tickets which are registered. Targeting communications to the registered player based on the collected identifying information. Entering the registered player in at least one of the additional lotteries in exchange for at least a portion of the allocated points which correspond with a number of entry points to participate. Conducting the additional lottery and providing the participating registered players with an outcome.

12 Claims, 1 Drawing Sheet

U.S. PATENT DOCUMENTS

2007/0060344 A1 3/2007 Watkins et al.
2007/0191084 A1* 8/2007 Tarantino ..... 463/16
2008/0032787 A1* 2/2008 Low et al. ..... 463/29
2008/0174068 A1* 7/2008 York et al. ..... 273/139
2009/0176579 A1* 7/2009 Herrmann et al. ..... 463/43
2009/0176580 A1* 7/2009 Herrmann et al. ..... 463/43

* cited by examiner

METHOD FOR CONDUCTING A LOTTERY

CROSS-REFERENCE TO RELATED APPLICATION

The present application claims the benefit of provisional patent application Ser. No. 60/873,319 filed Dec. 7, 2006, which is incorporated herein by reference.

TECHNICAL FIELD

The present invention relates to a method for conducting a lottery. More specifically, it relates to a method for conducting a lottery that offers players who lose the opportunity to use their losing lottery tickets to enter one or more additional lotteries.

BACKGROUND INFORMATION

More states are conducting lotteries, and there are an ever increasing number of lotteries conducted by any given state or combination of states. As a result, lotteries as a whole have lost some of their novelty and appeal to the public. Moreover, most lotteries are conducted in such a manner that the players remain anonymous so it is not possible to communicate with the players about the lottery or to accumulate demographic information to be used to make the lotteries more attractive to existing players. It is a purpose of the present invention (i) to increase the perceived value of a lottery ticket; (ii) to attract new players to existing lotteries; (iii) to build a customer database of addressable players; and (iv) to communicate with players to encourage participation.

SUMMARY

The present invention is a method of conducting a lottery that offers players who lose the opportunity to use their losing lottery tickets to enter one or more additional lotteries at no additional cost, a replay program. Players may use their losing lottery tickets to enter an additional lottery and to use points assigned to their losing lottery tickets to enter still more additional lotteries.

BRIEF DESCRIPTION OF THE DRAWINGS

These and other features and advantages of the present invention will be better understood by reading the following detailed description, taken together with the drawings wherein a preferred embodiment is shown as follows.

DETAILED DESCRIPTION OF THE INVENTION

Figure 1:
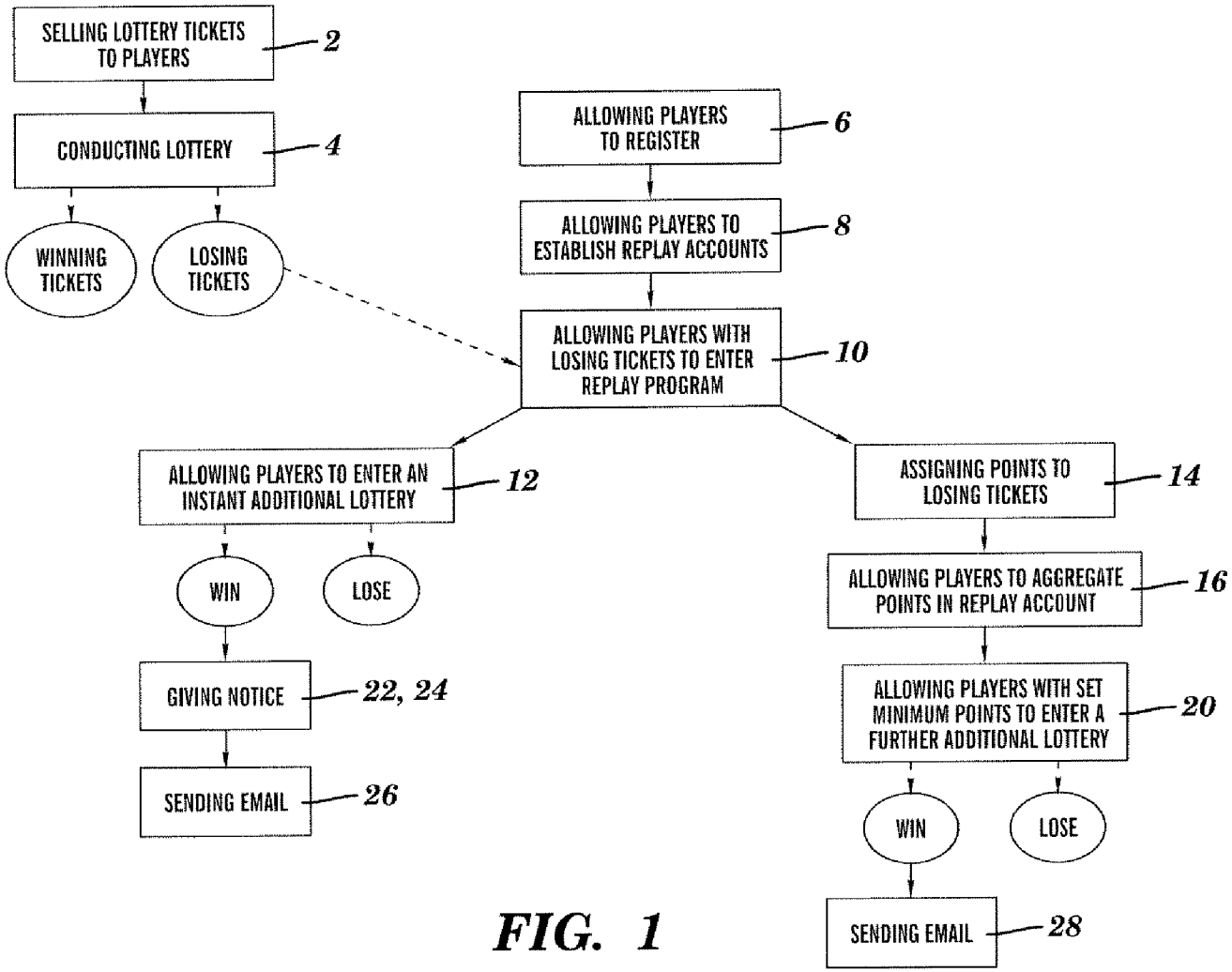
FIG. 1 shows a flowchart of a method for conducting a lottery according to the present invention.

The present invention is a method of conducting a lottery that offers players who lose the opportunity to use one or more of their losing lottery tickets to enter one or more additional lotteries at no additional cost, a replay program. A player registers to participate in the additional lotteries through an authorized website maintained by the lottery host, or entity conducting the lottery, or by mail. The player then uses one or more of his losing lottery tickets to enter an additional lottery using points assigned to one or more of his losing tickets to enter still more additional lotteries, the number of points necessary to enter any such additional lottery being dependent on the prize being offered in the lottery.

It is to be understood that, as used herein, lottery includes both "on-line games," or games in which on-line tickets with numbers to be matched to a winning number are sold from sales terminals and "scratch games," or games in which a scratch ticket requires a player to remove a covering to reveal play symbols to determine if the play symbols are a winning combination in accordance the game rules. Each on-line ticket and each scratch ticket has a number or combination of numbers on it that are unique to the ticket (the "identifying number").

In a preferred embodiment, a lottery host first establishes eligibility rules for determining which losing lottery tickets are eligible for additional lotteries. For example, only scratch tickets sold after a given date may be eligible or otherwise eligible tickets may become ineligible on the expiration of one year from the termination of the scratch game or the drawing of the winner of the on-line game. The lottery host may also establish eligibility rules for players, requiring a minimum age and specific geographic residency.

As shown in FIG. 1 for a preferred embodiment, a lottery host sells lottery tickets 2 that each have a set cost and a unique identifying number to players. The host then conducts a lottery 4 such that one or more lottery tickets sold are winning tickets, and the remainder of lottery tickets sold are losing tickets. A player is allowed to register, either before or after purchasing a ticket that is a losing ticket, to participate in the replay program 6. The player registers by visiting the authorized website of the lottery host and providing certain identifying information, typically name, password, mail and email addresses, phone number and birth date. The player also indicates, for example by checking boxes, that he has read, and is in compliance with, any player eligibility rules established by the lottery host and accepts the terms and conditions for play established by the entity lottery host. The player may also optionally indicate that he would like to receive email communications concerning lottery updates and promotions. The player is then allowed to establish a replay account 8.

A player with a replay account is then allowed to enter the replay program 10 either through the lottery host's authorized website or by mail. A player entering through the authorized website logs-in to his replay account and provides a losing ticket's identifying number. A player entering through the mail provides identifying personal information and the losing ticket. A player's entry may be electronically validated, as to the cost of the ticket and other features, based on the ticket's identifying number.

A player with a replay account is allowed to participate in an instant additional lottery 12. Winners of an instant additional lottery are selected by a software algorithm, based on the number of prizes available and the number of entries anticipated, upon completion of the player's entry. A winner may accept the designated prize or trade it for a specified number of points, to be used as described below.

Losing tickets are also assigned points 14. The points are a non-monetary numerical value assigned by the lottery host typically based on the initial cost of the losing ticket. The number of points assigned may be based on other factors, including number of other players referred and participation in surveys. The points assigned to a player's one or more losing tickets are aggregated in his replay account 16. The lottery host then conducts one or more further additional lotteries for designated prizes as described below. Each such further additional lottery requires a player to have at least a specified number of points in his replay account. A player is allowed to enter such further additional lottery if his replay account has in it at least the requisite number of points for that additional lottery 20. A player is allowed to enter the lottery host's website and select a further additional lottery, to enter his replay account name and password, to designate the number of points he would like to exchange for one or more entries, and to submit the one or more entries.

Points used to enter such further additional lotteries are deducted 22 from a player's replay account. Winners of further additional lotteries are determined by a random selection process implemented by a software algorithm.

In a preferred embodiment, the prizes offered for an instant or further additional lottery may be cash, additional points, or promotional prizes, which are prizes provided by businesses in exchange for promotional consideration. Winners of instant additional lotteries who enter on-line may be notified immediately upon completion of ticket entry 22. A screen appears with a prize description and prize redemption instructions. Winners of instant additional lotteries who entered by mail are notified by mail or by telephone 24. A prize description and prize redemption instructions are included with the notification. A confirmation email is also sent to the winning player 26. Redemptions of prizes may be through one or more of the following methods: mail, in person pickup or coupons transmitted through the internet.

Winners of further additional lotteries who enter on-line are notified after the drawings by email 28. The email notice contains a prize description and redemption instructions. Winners of further additional lotteries who entered by mail are notified after the drawing by mail. The mail notice contains a prize description and redemption instructions While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention.

What is claimed is:

1. A system for managing one or more replay lotteries, the method comprising:

logic embodied on at least one non-transitory computer readable medium configured to receive data about one or more losing lottery tickets from one or more participating lotteries for one or more point accounts;

logic embodied on at least one non-transitory computer readable medium configured to add an assigned amount of points for each of the losing tickets into a balance for the one or more point accounts based on the received data;

logic embodied on at least one non-transitory computer readable medium configured to conduct one or more replay lotteries based on one or more entries received from the one or more point accounts in exchange for an entry amount deducted for each of the received entries from the balance of each of the one or more point accounts from which the entries are received; and logic embodied on at least one non-transitory computer readable medium configured to identify one or more winners for each of the conducted replay lotteries from the received entries.

2. The system as set forth in claim 1 further comprising logic embodied on at least one non-transitory computer readable medium configured to receive registration data to open the point accounts, the registration data comprising one or more items of contact information and one or more items of demographic information.

3. The system as set forth in claim 2 wherein the items of contact information comprise one or more of postal address, email address, and phone number.

4. The system as set forth in claim 2 wherein the items of demographic information comprises one or more of name, birth date, and postal address.

5. The system as set forth in claim 2 further comprising logic embodied on at least one non-transitory computer readable medium configured to provide a communication regarding at least one of the replay lotteries and one or more promotions to one or more of the point accounts based on the received contact information.

6. The system as set forth in claim 1 further comprising logic embodied on at least one non-transitory computer readable medium configured to determine which of the losing lottery tickets from the received data are eligible to participate based on one or more eligibility factors, wherein the adding an assigned amount further comprises adding the assigned amount when the determining that the received data about the losing lottery tickets is eligible.

7. The system as set forth in claim 6 wherein the one or more eligibility factors further comprise one or more of a minimum age, a set geographic area, and a purchase date of the lottery tickets.

8. The system as set forth in claim 1 wherein the adding an assigned amount further comprises determining the assigned amount based on one or more assigned value factors.

9. The system as set forth in claim 8 wherein the one or more assigned value factors comprises an initial cost of the losing tickets, a number of new point accounts referred for registration, and an amount of participation in one or more surveys.

10. The system as set forth in claim 1 wherein the identifying one or more winners for each of the conducted replay lotteries further comprises providing a display of the one or more winners at the time a winner is determined.

11. The system as set forth in claim 1 wherein the identifying one or more winners for each of the conducted replay lotteries further comprises transmitting a communication to the one or more winners.

12. The system as set forth in claim 1 further comprising:

logic embodied on at least one non-transitory computer readable medium configured to receive a selection of a prize amount from one or more of the winners; and logic embodied on at least on non-transitory computer readable medium configured to conduct to add the prize amount to the balance for point accounts which the selection was received.

* * * * *